US011850707B2

(12) United States Patent
Blumenthal et al.

(10) Patent No.: US 11,850,707 B2
(45) **Date of Patent: *Dec. 26, 2023**

(54) LOCKING PLIERS WITH MOVABLE TORQUE-INCREASING JAW SECTION

(71) Applicant: Milwaukee Electric Tool Corporation, Brookfield, WI (US)

(72) Inventors: Aaron S. Blumenthal, Shorewood, WI (US); Christopher S. Hoppe, Cedarburg, WI (US); Aaron M. Williams, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/576,491

(22) Filed: Jan. 14, 2022

(65) Prior Publication Data

US 2022/0134514 A1 May 5, 2022

Related U.S. Application Data

(63) Continuation of application No. 16/137,020, filed on Sep. 20, 2018, now Pat. No. 11,247,308, which is a (Continued)

(51) Int. Cl.
*B25B 7/12* (2006.01)
*B25B 7/04* (2006.01)
(Continued)

(52) U.S. Cl.
CPC ..... *B25B 7/123* (2013.01); *B25B 7/04* (2013.01); *B25B 23/00* (2013.01); *B25B 13/5058* (2013.01)

(58) Field of Classification Search
CPC .... B25B 7/02; B25B 7/04; B25B 7/08; B25B 7/10; B25B 7/12; B25B 7/123; B25B 5/04; B25B 5/147; B25B 13/5058; B25B 23/00
(Continued)

(56) References Cited

U.S. PATENT DOCUMENTS 1,125,945 A 1/1915 Solina et al.
1,813,038 A 7/1931 Erne
(Continued)

FOREIGN PATENT DOCUMENTS

AU 5917990 A 2/1991
CA 2276121 12/2000
(Continued)

OTHER PUBLICATIONS

Monster & Master, Curved Jaw Locking Plier Set, Date first available Apr. 22, 2019, [online]retrieved Sep. 23, 21,available from https://www.amazon.com/Monster-Master-Locking-2-Piece-M M-H I P-003x2/dp/B07R2N67LC/ref=pd_di_sccai_1/134-5564337-2927451?pdrd w=gQTo8&pfrdp=c9443270-b914-4430-a90b-72e3e7e784e (Year: 2019).
(Continued)

*Primary Examiner* — Laura C Guidotti
*Assistant Examiner* — Abbie E Quann
(74) *Attorney, Agent, or Firm* — Reinhart Boerner Van Deuren s.c.

(57) ABSTRACT

Pliers are provided. Pliers include an upper handle, a lower handle, an upper jaw coupled to the upper handle, and a lower jaw coupled to the lower handle. In general, the upper jaw includes workpiece engagement surface, such a first set of teeth configured to engage a workpiece, and the lower jaw includes a workpiece engagement surface, such as a second set of teeth and a third set of teeth. The lower jaw opposes
(Continued)

the upper jaw such that the first set of teeth faces the second set of teeth and the third set of teeth. At least a section of the workpiece engagement surface of the lower jaw is movably coupled to the lower jaw such that it moves relative to the lower as torque is applied to a workpiece, thereby increasing torque applied to the workpiece.

20 Claims, 9 Drawing Sheets

Related U.S. Application Data continuation of application No. PCT/US2018/050474, filed on Sep. 11, 2018.

(60) Provisional application No. 62/581,421, filed on Nov. 3, 2017, provisional application No. 62/556,793, filed on Sep. 11, 2017.

(51) Int. Cl.
*B25B 23/00* (2006.01)
*B25B 13/50* (2006.01)

(58) Field of Classification Search
USPC ..... 81/418, 478, 479, 367, 357
See application file for complete search history.

(56) References Cited

U.S. PATENT DOCUMENTS 2,280,005 A 8/1940 Petersen
2,285,683 A 6/1942 Seashore
2,341,489 A 2/1944 Tornborg
2,478,696 A 8/1949 Isele
2,499,201 A 2/1950 Thayer
2,528,814 A 11/1950 Boyer
2,584,353 A * 2/1952 Keiser ..... B25B 7/02 81/347
2,592,803 A 4/1952 Heim
2,600,594 A 6/1952 Williamson
2,604,803 A 7/1952 Mccann
2,608,893 A 9/1952 Cranner
2,747,446 A 5/1956 Eder
RE24,465 E 4/1958 Waterburv
2,853,910 A 9/1958 Petersen
3,710,658 A 1/1973 Wilson
3,908,490 A 9/1975 Durham
4,044,413 A 8/1977 Tucker
D260,476 S 9/1981 Knaus
4,890,519 A 1/1990 Due
5,022,291 A 6/1991 McBain
5,056,385 A 10/1991 Petersen
5,351,585 A 10/1994 Lesebera et al.
5,456,144 A 10/1995 Dahl et al.
5,460,065 A 10/1995 Balmer
5,609,080 A 3/1997 Flavingy
5,927,159 A 7/1999 Yokoyama et al.
5,964,130 A * 10/1999 Wang ..... B25B 7/04 81/424
6,012,362 A 1/2000 Wana
6,212,978 B1 4/2001 Seber et al.
6,212,979 B1 4/2001 Wana
6,227,080 B1 5/2001 Grayo et al.
6,279,431 B1 8/2001 Seber et al.
6,279,433 B1 8/2001 Chervenak
6,282,996 B1 9/2001 Berg et al.
D462,247 S 9/2002 Hackman
6,450,070 B1 9/2002 Winkler
6,591,719 B1 7/2003 Poole et al.
6,626,070 B2 9/2003 Peperkorn et al.
6,748,829 B2 6/2004 Seber et al.
6,776,072 B2 8/2004 Poole et al.
6,857,342 B2 2/2005 Wana
6,889,579 B1 5/2005 Brown
6,941,844 B2 9/2005 Hile
6,973,859 B2 12/2005 Noniewicz
7,086,312 B1 8/2006 Tortolani
7,100,479 B2 9/2006 Seber et al.
7,134,365 B2 11/2006 Hile
7,146,887 B2 12/2006 Hunter
7,216,570 B2 5/2007 Seber et al.
7,348,453 B2 3/2008 Rozema et al.
7,363,669 B2 4/2008 Berg et al.
7,389,714 B1 6/2008 Heagerty
7,434,498 B2 10/2008 Johnson
7,444,907 B2 11/2008 Seber et al.
7,454,999 B2 11/2008 Wu
7,472,632 B2 1/2009 Engvall et al.
D588,890 S 3/2009 Ibarrondo
D599,637 S 9/2009 Valencia
7,721,630 B2 5/2010 Hunter
7,726,217 B2 6/2010 Engvall et al.
7,730,810 B1 6/2010 Janson
7,748,298 B2 7/2010 Brown
7,861,622 B2 1/2011 Chervenak et al.
D635,427 S 4/2011 Chervenak et al.
D635,428 S 4/2011 Lucas
7,992,470 B2 8/2011 Brown
8,024,998 B1 9/2011 Valencia
8,056,451 B2 11/2011 Chervenak et al.
D651,060 S 12/2011 Chervenak et al.
D653,092 S 1/2012 Carra
8,122,792 B2 2/2012 Engvall et al.
8,186,246 B2 5/2012 Niven
8,225,700 B2 7/2012 Hile
8,266,990 B1 9/2012 Janson
8,302,512 B2 11/2012 Shih
8,402,863 B2 3/2013 Brown
8,408,100 B2 4/2013 Liu
8,429,948 B1 4/2013 Warren
8,479,618 B2 7/2013 Hsiao
8,631,725 B2 1/2014 Tuan-Mu
8,833,209 B2 9/2014 Brown
8,950,299 B2 2/2015 Wu
9,027,447 B2 5/2015 Cripps
9,216,494 B2 12/2015 Lai
9,242,349 B2 1/2016 Battenfeld
D771,456 S 11/2016 Hyma
9,496,671 B2 11/2016 Dierks et al.
D782,891 S 4/2017 Hvma
9,634,451 B2 4/2017 Battenfeld
D801,770 S 11/2017 Bridges et al.
D803,021 S 11/2017 Wu
9,844,857 B2 12/2017 Skodie et al.
9,962,813 B2 5/2018 Buchanan
D835,486 S 12/2018 Wu
10,391,614 B1 8/2019 Aldredge
11,247,308 B2 * 2/2022 Blumenthal ..... B25B 7/12
2004/0055430 A1 3/2004 Wong
2005/0097997 A1 5/2005 Hile
2005/0204874 A1 9/2005 Cheng
2005/0235786 A1 10/2005 Yueh-Chiang
2007/0044317 A1 3/2007 Critelli
2008/0060486 A1 3/2008 Robert
2008/0173143 A1 7/2008 Wu
2008/0196561 A1 8/2008 Wu
2008/0276766 A1 11/2008 Phillips et al.
2009/0044666 A1 2/2009 Xinhong
2010/0018361 A1 1/2010 Chervenak et al.
2010/0018362 A1 1/2010 Chervenak et al.
2010/0018363 A1 1/2010 Chervenak et al.
2010/0186558 A1 7/2010 Hile
2010/0218648 A1 9/2010 Chervenak et al.
2011/0107880 A1 5/2011 Stucky
2011/0203421 A1 8/2011 Chervenak et al.
2012/0031243 A1 2/2012 Shih
2012/0096995 A1 4/2012 Shih
2012/0096998 A1 4/2012 Shih
2012/0167728 A1 7/2012 Miramontes
2012/0318107 A1 12/2012 Mann
2013/0014618 A1 1/2013 Wu
2013/0047794 A1 2/2013 Huanq

(56) References Cited

U.S. PATENT DOCUMENTS

| | | | |
|---|---|---|---|
| 2013/0192429 | A1 | 8/2013 | Cripps |
| 2013/0228046 | A1 | 9/2013 | Wu |
| 2013/0239759 | A1 | 9/2013 | Huanq |
| 2015/0000477 | A1 | 1/2015 | Wu |
| 2015/0217430 | A1 | 8/2015 | Wu |
| 2015/0239102 | A1 | 8/2015 | Wu |
| 2015/0246432 | A1 | 9/2015 | Craig et al. |
| 2015/0246433 | A1 | 9/2015 | Wu |
| 2015/0273664 | A1 | 10/2015 | Skodje et al. |
| 2015/0283681 | A1 | 10/2015 | Wu |
| 2016/0039072 | A1 | 2/2016 | Wu |
| 2016/0129565 | A1 | 5/2016 | Watson et al. |
| 2016/0207175 | A1 | 7/2016 | Hyma et al. |
| 2017/0203413 | A1 | 7/2017 | Wu |
| 2017/0203414 | A1 | 7/2017 | Wu |
| 2017/0246731 | A1 | 8/2017 | Wu |
| 2018/0021925 | A1 | 1/2018 | Bridges et al. |
| 2019/0061138 | A1 | 2/2019 | Chang |
| 2019/0076994 | A1 | 3/2019 | Blumenthal et al. |
| 2020/0094382 | A1 | 3/2020 | Blumenthal et al. |
| 2020/0331123 | A1 | 10/2020 | Wu |
| 2020/0368879 | A1 | 11/2020 | Wu |
| 2020/0384613 | A1 | 12/2020 | Bendorf |
| 2021/0008692 | A1 | 1/2021 | Bayle |

FOREIGN PATENT DOCUMENTS

| | | | |
|---|---|---|---|
| CA | 2276121 | A1 | 12/2000 |
| CN | 3356149 | | 3/2004 |
| CN | 2706278 | Y | 6/2005 |
| CN | 201483397 | U | 5/2010 |
| CN | 302746426 | | 10/2013 |
| CN | 203390768 | U | 1/2014 |
| CN | 203918820 | U | 11/2014 |
| CN | 104275655 | | 1/2015 |
| CN | 101659041 | B | 3/2015 |
| CN | 102873654 | B | 9/2015 |
| CN | 303689154 | | 9/2015 |
| CN | 303548590 | | 1/2016 |
| CN | 104139347 | B | 9/2016 |
| CN | 304121603 | | 12/2016 |
| CN | 206216529 | U | 6/2017 |
| CN | 304552193 | | 10/2017 |
| CN | 305310543 | | 8/2019 |
| CN | 305659366 | | 9/2019 |
| DE | 1810295 | | 4/1960 |
| DE | 3909603 | | 9/1990 |
| DE | 29703681 | U1 | 6/1997 |
| DE | 20302867 | U1 | 5/2003 |
| DE | 102006039759 | | 2/2008 |
| DE | 202013101985 | U1 | 5/2013 |
| EM | 002699454-0005 | | 5/2015 |
| EP | 0861707 | B1 | 5/2002 |
| EP | 2149428 | A1 | 2/2010 |
| EP | 2546028 | B1 | 8/2014 |
| EP | 2801444 | A1 | 11/2014 |
| KR | 300686777 .0000 | | 10/2011 |
| TW | 519572 | U | 4/2016 |
| TW | M547458 | | 8/2017 |
| WO | WO0166311 | | 9/2001 |
| WO | WO2015024405 | | 2/2015 |
| WO | WO2017165591 | A1 | 9/2017 |

OTHER PUBLICATIONS

Crescent Store, Curved Jaw, Locking Pliers, Date first available May 1, 2016, [online]retrieved Jun. 15, 2021, available from https://www.amazon.com/dp/BO1F1 NZJKQ/ref=sspa_dk_detaii_1?psc=l&pd_rd_i=B01F1NZJKQ&pd_rd_w=Dxua3&pf_rd_p=5d846283-ed3e-4512-a744-a3Of97c5d738&pd rd wg=9El90&pf rd r=OHPV53A1JDZ5TFSOJ (Year: 2016).

Irwin Store, Vise-Grip Curved Jaw Locking Pliers, Date first available Nov. 19, 2003, [online]retrieved Jun. 15, 2021, available from https://www.amazon.com/gp/product/B00012FQGA?ie=UTF8&linkCode=xm2&tag=bestcoverycom-2O (Year: 2003).

Monster & Master, Curved Jaw Locking Plier Set, Date first available Apr. 22, 2019, [online]retrieved Sep. 23, 2021, available from https://www.amazon.com/Monster-Master-Locking-2-Piece-M M-H I P-003x2/dp/B07R2N67LC/ref=pd_di_sccai_1/134-5564337-2927451?pdrd w=gQTo8&pfrdp=c9443270-b914-4430-a90b-72e3e7e784e (Year: 2019).

Chambridge, Chambridge 10-Inch Curved Jaw Locking Pliers, 10" Vise Grips, Original Locking Pliers, grip Locking Pliers. Date first available Oct. 8, 2019, [online]retrieved May 14, 2020, available from internet, www.amazon.com (Year: 2019).

Crescent Store, Curved Jaw, Locking Pliers, Date first available May 1, 2016, [online]retrieved Jun. 15, 21, available from https://www.amazon.com/dp/BO1F1 NZJKQ/ref=sspa_dk_detaii_1?psc=l&pd_rd_i=B01F 1NZJKQ&pd_rd_w=Dxua3&pf_rd_p=5d846283-ed3e-4512-a744-a3Of97c5d738&pd rd wg=9E190&pf rd r=OHPV53A1JDZ5TFSOJ (Year: 2016).

International Search Report and Written Opinion for International Application No. PCT/US2018/050474 dated Jan. 4, 2019, 10 pages.

Irwin Store, VISE-GRIP Curved Jaw Locking Pliers, Date first available Nov. 19, 2003, [online]retrieved Jun. 15, 2021, available from https://www.amazon.com/gp/product/B00012FQGA?ie=UTF8&linkCode=xm2&tag=bestc overycom-20 (Year: 2003).

Milwaukee, 4" Torque Lock™ Curved Jaw Locking Pliers. [online]retrieved May 22, 2020, available from internet, https://www.milwaukeetool.com/Products/Hand-Tools/Pliers/Locking-Pliers/48-22-3423 (Year: 2020).

Milwaukee, Milwaukee 48-22-3420 10 in. Locking Pliers Curved Jaw, Date first available May 9, 2013, [online]retrieved May 21, 2020, available from internet, www.amazon.com (Year: 2013).

Milwaukee, Milwaukee 48-22-3506 6" Long Nose Locking Pliers, Date first available Dec. 9, 2015, [online]retrieved May 21, 2020, available from internet, www.amazon.com (Year: 2015).

Steelhe Store, Piece Locking Pliers Set, Date first available Jul. 4, 2019, [online]retrieved Jun. 15, 2021, available from https://www.amazon.com/3-Piece-Locking-Pliers-Set-6-5/dp/B07TWP73Q4/ref=pd_sbs12/130-4064296-2864548?pd_rd_w=4w5ct&pf_rd_p=a5925d26-9630-40f3-a011-d858608ac88b&pf rd r=9M0A04V73ECQRN PGV (Year: 2019).

* cited by examiner

LOCKING PLIERS WITH MOVABLE TORQUE-INCREASING JAW SECTION

CROSS-REFERENCE TO RELATED PATENT APPLICATIONS

The present application is a continuation of U.S. application Ser. No. 16/137,020, filed on Sep. 20, 2018, which is a continuation of International Application No. PCT/US2018/050474, filed on Sep. 11, 2018, which claims the benefit of and priority to U.S. Provisional Application No. 62/581,421, filed on Nov. 3, 2017, and to U.S. Provisional Application No. 62/556,793, filed Sep. 11, 2017, which are incorporated herein by reference in their entireties.

BACKGROUND OF THE INVENTION

The present invention relates generally to the field of pliers. The present invention relates specifically to pliers with a torque increasing jaw design. Pliers typically include two plier members connected through a pivot that allows the upper handle to move a lower jaw and a lower handle to move an upper jaw about the pivot. Locking pliers generally have a similar pivot to grip a workpiece but include a further locking mechanism to keep the jaws a fixed distance from one another.

SUMMARY OF THE INVENTION

One embodiment of the invention relates to a pair of locking pliers. The locking pliers include an upper handle, a lower handle, an upper jaw and a lower jaw. The upper jaw is coupled to the upper handle and includes a first set of teeth configured to engage a workpiece. The lower jaw is coupled to the lower handle and includes a second set of teeth and a third set of teeth. The lower jaw opposes the upper jaw such that the first set of teeth faces the second set of teeth and the third set of teeth. A first pivot joint couples the lower handle to the upper handle such that the upper handle is movable relative to the lower handle to move the lower jaw relative to the upper jaw. A second pivot joint couples the third set of teeth to the lower jaw. The second set of teeth on the lower jaw are pivotable about the first pivot and the third set of teeth on the lower jaw are pivotable about the first pivot joint and about the second pivot joint. The locking pliers further include a locking mechanism configured to lock a position of the upper jaw relative to the lower jaw.

Another embodiment of the invention relates to pliers. The pliers include a first assembly comprising a first handle, a first jaw, and a first workpiece engagement surface. The pliers include a second assembly comprising a second handle, a second jaw, a second workpiece engagement surface, and a third workpiece engagement surface. A pivot joint pivotably couples the first assembly to the second assembly such that the second handle is movable relative to the first handle to move the second jaw relative to the first jaw. The third workpiece engagement surface is movably coupled to the second jaw such that the third workpiece engagement surface moves relative to the second workpiece engagement surface as torque is applied to a workpiece.

Another embodiment of the invention relates to a tool for grasping a workpiece. The tool includes a first handle with a first jaw and a first workpiece engagement surface coupled to the first jaw, a second handle with a second jaw and a second workpiece engagement surface coupled to the second jaw. A first joint couples the first jaw to the second jaw. The first and second handles are movable relative to each other to cause the second jaw to move relative to the first jaw. A second joint couples the second workpiece engagement surface to the second jaw and allows the second workpiece engagement surface to move relative to the second jaw. The first jaw and the second jaw define a working area between the first jaw and the second jaw that decreases as the second workpiece engagement surface moves relative to the second jaw as a force is applied to the first and second handles, and a torque is applied the workpiece.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
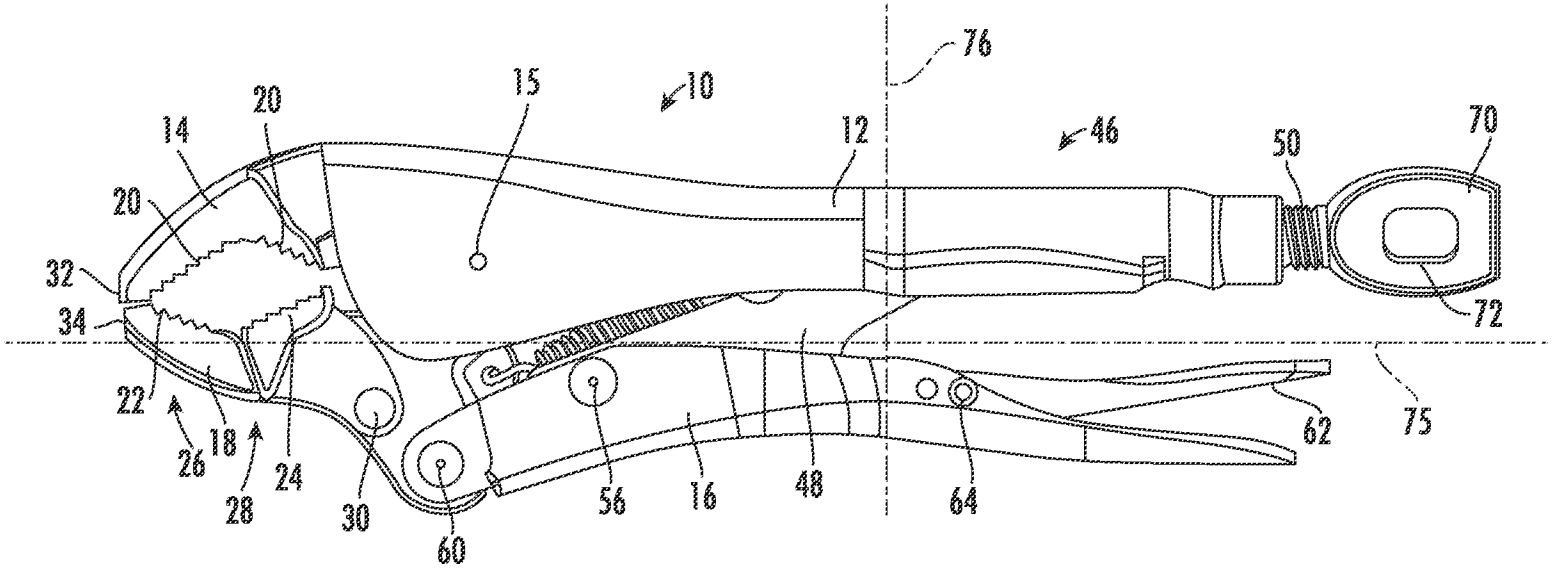
FIG. 1 is a side view of a pair of locking pliers, according to an exemplary embodiment.
Figure 2:
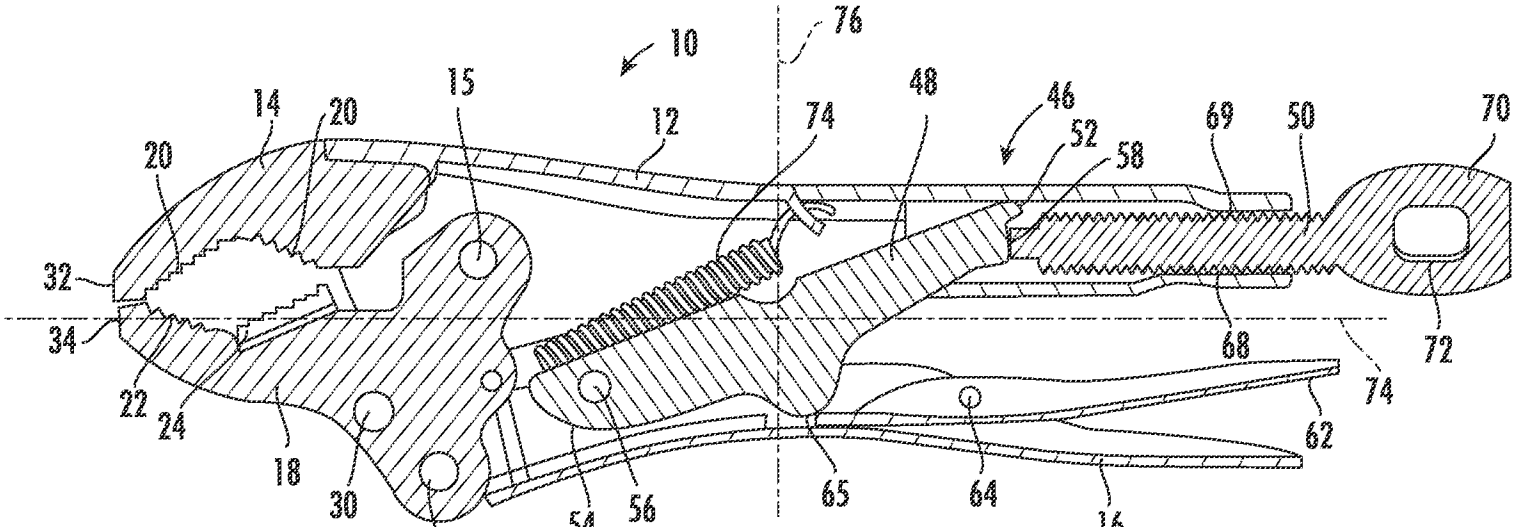
FIG. 2 is a longitudinal cross-sectional view of the locking pliers of FIG. 1, according to an exemplary embodiment.

Referring generally to the figures, various embodiments of pliers, specifically locking pliers, are shown. Pliers include a first handle and a first jaw pivotably coupled to a second handle and a second jaw through a first pivot. The pliers include opposing workpiece engagement surfaces on the first and second jaw In general, in the embodiments described herein, at least one of the workpiece engagement surfaces is moveably coupled to the associated jaw element allowing relative movement between the workpiece engagement surface and the jaw. Applicant has found that as torque is applied to a workpiece, the relative motion between the workpiece engagement surface and the jaw significantly increases torque (e.g., increases by 10%-70% or more) as compared to pliers with fixed workpiece engagement surfaces. In some embodiments, Applicant believes that the designs discussed herein increase the torque applied to the workpiece before slipping by at least 10%-70%, such as by 50%, 60%, 70%, 80%, 90%, 100%, or more as compared to pliers with fixed workpiece engagement surfaces.

In specific embodiments described herein, the workpiece engagement surfaces are sets of teeth located on the upper and lower jaws, and a second pivot attached to the lower jaw enables rotation of a segment of teeth located on the lower jaw relative to the lower jaw. This rotation of lower teeth enhances the grip applied as the pliers are rotated about the workpiece, thus increasing the torque applied on the workpiece without slippage.

In some embodiments, the pliers lock through a third pivot. The locking mechanism allows the pliers to be placed on a workpiece and lock the jaws in a fixed position to retain a gripping force without gripping the handles. Although the description below applies to locking pliers, in various embodiments, the movable workpiece engagement surfaces (e.g., the second pivot enabling the movable teeth) as discussed herein may be utilized to enhance torque for a wide variety of gripping tools, such as non-locking pliers, wrenches, etc.

In particular, traditional locking pliers enable more torque on a workpiece compared to non-locking pliers by increasing the grip applied and locking the gripping force through rotation of the workpiece. Pliers serve many functions at a worksite but are often used to grip a workpiece and rotate the workpiece in a given direction. Traditional pliers allow an operator to "grip" the handles of the pliers and rotate the handles about the workpiece to tighten or loosen the workpiece. Some pliers lock to remove the need to continuously apply the gripping force as the pliers rotate about the workpiece. Locking pliers enable the operator to set and apply the gripping force, the upper and lower jaw then retain the set fixed position as the pliers rotate about the workpiece.

In one embodiment, the lower jaw, or a movable face of the lower jaw, is separately pinned to a pivot. Thus, when the operator applies torque to a workpiece, the lower jaw, or movable face of the lower jaw, pivots to increase the locking or gripping force. The lower jaw, or a movable face of the lower jaw, may separately rotate such that parts of the lower jaw are pivotable about different pivot points. Thus, when a force applied to the pliers generates torque on the workpiece, the lower jaw, or movable face of the lower jaw, is allowed to pivot to increase locking force or grip. The force on the handles generates a torque on a workpiece that is at least 10-70% greater with the rotatable movable face of the lower jaw than the torque produced by the same force on the same pliers without the second pivot joint. In some embodiments, the torque applied on a workpiece increases 70% or more.

FIG. 1 illustrates pliers 10 with a first or upper handle 12 coupled to a first or upper jaw 14 and a second or lower handle 16 coupled to a second or lower jaw 18. Upper handle 12 and upper jaw 14 couple to the lower handle 16, and lower jaw 18 through a first pivot 15 configured to open and close the jaw. The upper jaw 14 and lower jaw 18 are configured to open and insert a workpiece in the space between the jaws and close to grip the workpiece, e.g., to clamp the workpiece. The upper jaw 14 may include a first set of teeth 20 configured to engage the workpiece. The lower jaw 18 opposes the upper jaw 14 and may include a second set of teeth 22 and a third set of teeth 24 opposite the first set of teeth 20 on the upper jaw 14. The second set of teeth are disposed on a first portion 26 of the lower jaw 18, and the third set of teeth 24 are disposed on a second portion 28 that rotates about a second pivot 30. In this configuration, the third set of teeth 24 provide a lever arm 41 that increases the torque applied to the workpiece as force is applied to the upper and lower handles 12, 16.

With reference to FIGS. 1-5, a hand tool in the form of locking pliers 10 is illustrated according to one embodiment of the invention. Locking pliers 10 include an upper jaw 14 and an upper handle 12 coupled to the upper jaw 14. The locking pliers 10 also include a movable lower jaw 18 and a lower handle 16 pivotally coupling the upper jaw 14 to lower jaw 18 at a first pivot 15. The lower handle 16 is pivotable about the first pivot 15 to move the lower jaw 18 relative to the upper jaw 14 between an open position and a closed position (FIG. 1). The upper jaw 14 includes a distal end 32 opposite the upper handle 12, and the lower jaw 18 includes a distal end 34 opposite the lower handle 16.

Clamping or squeezing the upper and lower handles 12, 16 provides a clamping force on the upper and lower jaws 14, 18. When a rotational force applied to the handles 12, 16 becomes a torque on a workpiece, it forces the rotation of the workpiece and generates friction on the jaws 14 and 18. For example, when the handles 12, 16 are clamped and rotated in a clockwise direction a clockwise torque is applied to the workpiece. The torque causes the second portion 28 of the lower jaw 18, including the third set of teeth 24, to pivot about the second pivot 30 in the clockwise direction due to the friction in the counter-clockwise direction. The rotation of the second portion 28 or the lower jaw 18 increases the clamping force applied to the workpiece. With this increased clamping force an operator can apply an increased amount of torque on the workpiece in the clockwise direction without slipping or losing the clamping force. In some embodiments, the amount of torque is increased 10%, 15%, 20%, 25%, 30%, 35%, 40%, 45%, 50%, 55%, 60%, 65%, 70% or more.

As described above, the first pivot 15 enables rotatable coupling of the upper handle 12 and upper jaw 14 to the lower handle 16 and lower jaw 18. As the handles 12, 16 are squeezed or tightened the lower jaw 18 moves relative to the upper jaw 14 to reduce a working area, defined as the area between the upper jaw 14 and the lower jaw 18. The first pivot 15 is a joint that couples the lower handle 16 to the upper handle 12 such that the upper handle 12 is movable relative to the lower handle 16 to move the lower jaw 18 relative to the upper jaw 14. In other words, the lower handle 16 pivots with respect to the upper handle 12 to increase or decrease a distance D (e.g., FIG. 3) between the distal end 32 of the fixed upper jaw 14 and the distal end 34 of the movable lower jaw 18.

In some embodiments, the second pivot joint or second pivot 30 couples the third set of teeth 24 to the lower jaw 18. The second pivot 30 joint allows the third set of teeth 24 to rotate about the second pivot 30 independent of the first pivot joint 15. In this configuration, the second set of teeth 22 on the lower jaw 18 are pivotable about the first pivot 15. The third set of teeth 24 on the lower jaw 18 are pivotable about both the first pivot 15 and the second pivot 30. When the third set of teeth 24 rotate about the second pivot 30, the working area decreases enhancing the clamping force. The third set of teeth reduces the diameter of the working area. This reduced area increases the clamping or gripping force on the workpiece and thereby increases the torque applied to the workpiece.

In some embodiments, various parameters determine the relative location of the first and second pivots 15, 30. For example, locking pliers 10 include a longitudinal axis 75 and a height axis 76. The second pivot 30 can be spaced relative to the first pivot 15 along the height axis such that the second pivot 30 is located in between the first pivot 15 and the lower handle 16. Moreover, the third set of teeth 24 can be located behind the second set of teeth 22. In this configuration, the third set of teeth 24 is located between the second set of teeth 22 and the first pivot 15 in the direction of the longitudinal axis 75.

Figure 3:
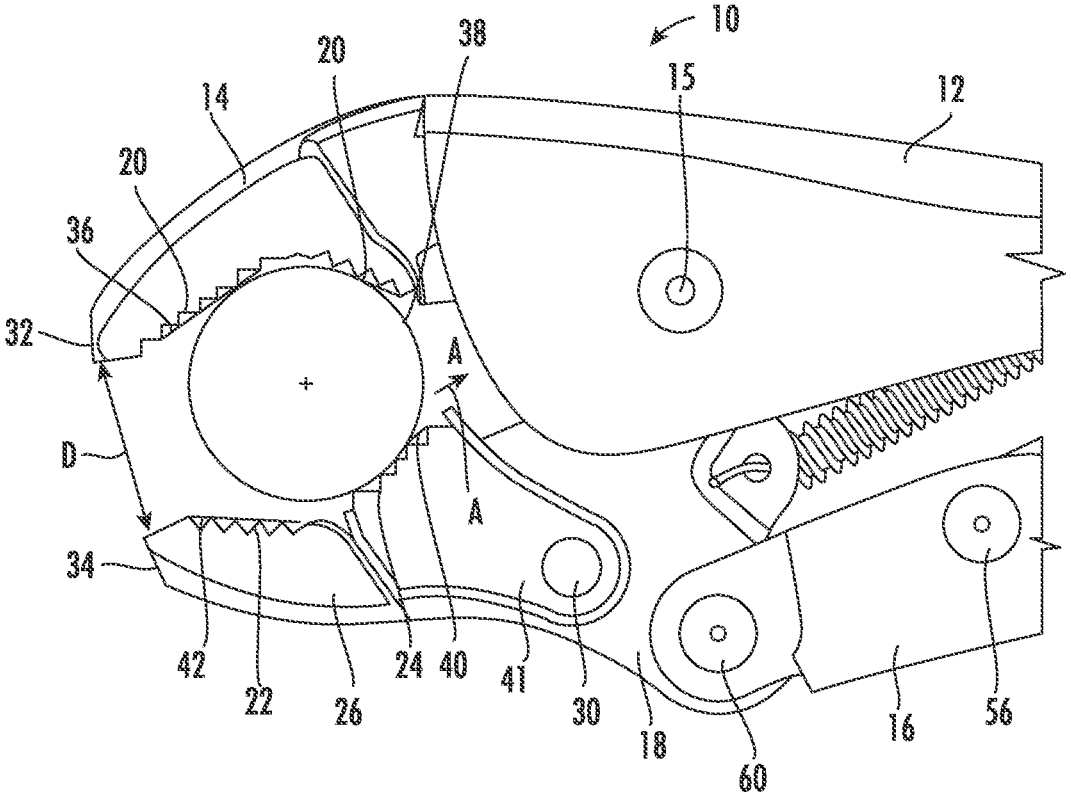
FIG. 3 is a side view of a portion of the locking pliers of FIG. 1 with a movable jaw that is opened to accommodate a workpiece, according to an exemplary embodiment.
Figure 4:
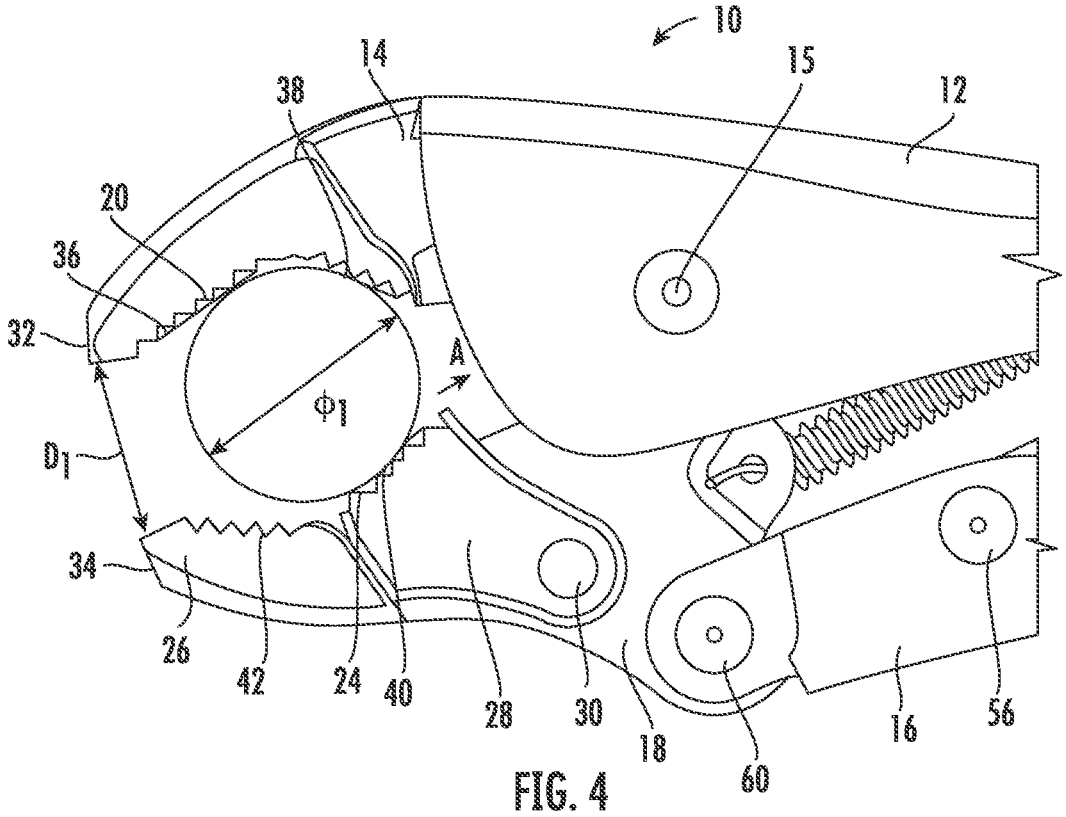
FIG. 4 is a side view of the locking pliers of FIG. 3, with a second pivot locating a portion of the movable jaw in a first position, according to an exemplary embodiment.
Figure 5:
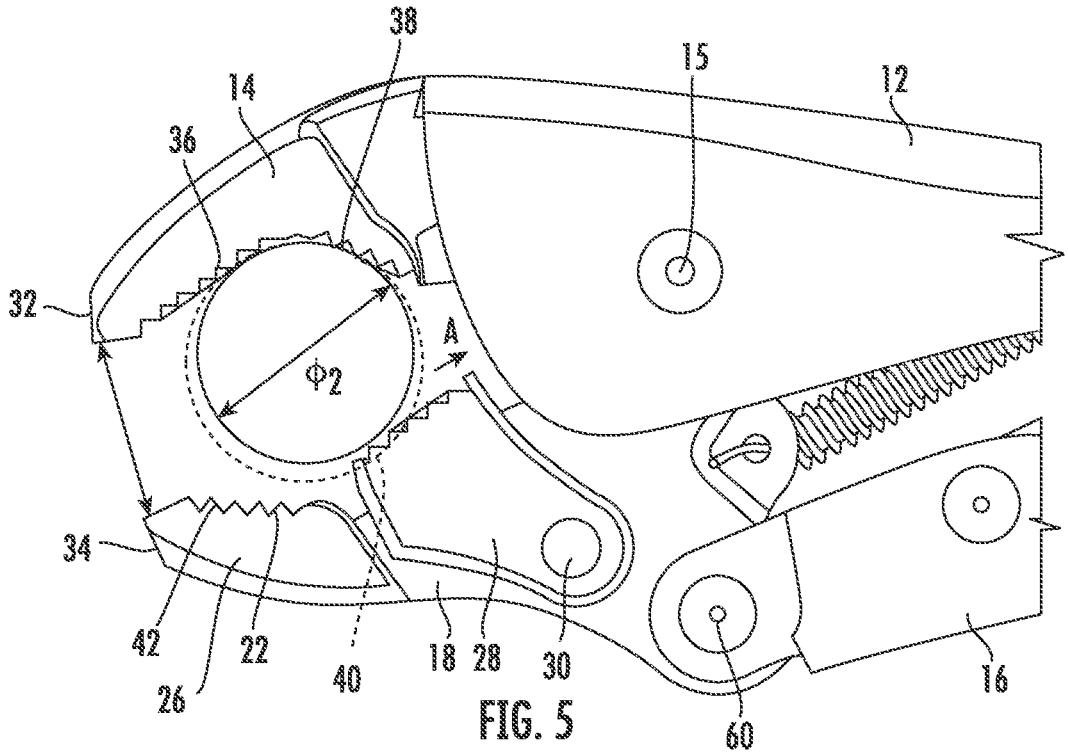
FIG. 5 is a side view of the locking pliers of FIG. 3, with a second pivot locating a portion of the movable jaw in a second position, according to an exemplary embodiment.

Referring to FIGS. 3-5, the upper jaw 14 includes a workpiece engagement surface 36 defined by a plane connecting the distal end 32 of the first set of teeth 20 located on the front of upper jaw 14. As illustrated, additional workpiece engagement surfaces 38 may include additional planes defined by distal ends of teeth 20 located at the rear of jaw 14. In the illustrated embodiment, an oblique angle connects the workpiece engagement surface 36 to the additional workpiece engagement surface 38 on the upper jaw 14. In some embodiments, the workpiece engagement surface 36 and the second jaw face 102 may be parallel, acute, or perpendicular. For purposes of this disclosure, unless noted otherwise workpiece engagement surface 36 includes all workpiece engagement surfaces on the upper jaw 14.

The lower jaw 18 includes a first portion 26 having a plurality of teeth 22 located at the front of the lower jaw 18 and a second portion 28 pivotally coupled to the first portion 26 by a second pivot 30. As described herein, this second pivot 30 enables the second portion 28, including the third set of teeth 24, to rotate and move relative to the first portion 26. The second portion 28 pivots relative to the first portion 26 from an initial position (illustrated in FIG. 4) toward a second position adjacent to the upper handle 12 (generally in the direction of arrow A as illustrated in FIG. 5). The rotation may be free or biased. A biased rotation applies a spring constant about the axis of the second pivot 30 to return the second portion 28 to the initial position. For example, a spring may rotate the second portion 28 of the lower jaw 18 to a resting position against the lower jaw 18 absent an applied torque. When a torque is applied, the clamping force may rotate the spring away from the resting or initial position and toward the rear of the working area.

In the initial position, the second portion 28 abuts a shoulder 44 on the lower jaw 18. The second portion 28 includes a plurality of teeth (e.g., the third set of teeth 24) located at a rear end of the lower jaw 18. A plane connecting the distal ends of the third set of teeth 24 defines the second workpiece engagement surface 40. As described in greater detail below, the second portion 28 is pivotable relative to the first portion 26 of the lower jaw 18 to vary the position and orientation of the second workpiece engagement surface 40 relative to the workpiece engagement surfaces 38, 40, and 42 on the upper and lower jaws 14, 18. The workpiece engagement surfaces 36, 38, 40, and/or 42 may be curved, planar, parabolic, angled, hexagonal, or comprise another shape.

The lower jaw 18 includes a second workpiece engagement surface 40 defined by a plane connecting the third set of teeth 120 on the second portion 28 of the lower jaw 18. As explained above, the lower jaw 18 may include additional workpiece engagement surfaces 42 or the second workpiece engagement surface 40 may comprise the entire lower jaw 18. For example, the first portion 26 of the lower jaw defines a plane with an additional workpiece engagement surface 42. The additional workpiece engagement surface connects the distal end 34 of the lower jaw 18 to an oblique angle where the second portion 28 of the lower jaw 18 begins. In the illustrated embodiment, an oblique angle orients the second workpiece engagement surface 40 to the additional workpiece engagement surface 42 on the lower jaw 18. In some embodiments, second workpiece engagement surface 40 and the additional workpiece engagement surface 42 may be parallel, acute, or perpendicular. For purposes of this disclosure, second workpiece engagement surface 40 includes only the second portion 28 that is pivotably coupled (e.g., through second pivot 30) to the lower jaw 18. Any additional workpiece engagement surfaces 42 will be separately identified and distinguished.

For example, the second pivot 30 allows the second workpiece engagement surface 40 to move relative to the second or lower jaw 18. The first or upper jaw 14 and lower jaw 18 define the working area (e.g., the area between the first jaw and the second jaw) that decreases as the second workpiece engagement surface 40 moves relative to the lower jaw 18 when a force introduces an applied torque on the workpiece. In some embodiments, the second workpiece engagement surface 40 may include the entire lower jaw 18, such that there are no additional workpiece engagement surfaces 42 on the lower jaw 18.

In other embodiments, a third workpiece engagement surface (e.g., additional workpiece engagement surface 42) may couple to the lower jaw 18. Similarly, a fourth workpiece engagement surface (e.g., additional workpiece engagement surface 38) may couple to the first jaw. In this configuration, there are two workpiece engagement surfaces 36, 38 on the upper jaw 14 and two workpiece engagement surfaces 40, 42 on the lower jaw 18. In some embodiments, the second workpiece engagement surface 40 on the second portion 28 of the lower jaw 18 pivots relative to the first, third, and fourth workpiece engagement surfaces 36, 38, and 42.

The second workpiece engagement surface 40 on the lower jaw 18 may include a plurality of aligned teeth (e.g., the third set of teeth 24) pivotable about the second pivot 30. The length of the third set of teeth 24 is measured between the front-most and rear-most teeth on the second portion 28 of the lower jaw 18. For example, the lower jaw 18 has a longitudinal length along a longitudinal axis 75 and a height along a height axis 76. The length of the third set of teeth 24 aligned along the second portion 28 of the lower jaw 18 may be at least 25% of the longitudinal length of the second jaw. As described above, the length may be 100% of the lower jaw 18. In some embodiments, the length of the third set of teeth 24 along the lower jaw may be 30%, 35%, 40%, 45%, 50%, 55%, 60%, 65%, 70%, 75%, 80%, 85%, 90%, 95%, or 100% the length of the lower jaw 18.

Returning to FIGS. 1 and 2, a locking mechanism 46 can be configured to lock a position of the upper jaw 14 relative to the lower jaw 18. Best illustrated in FIG. 2, locking pliers 10 include locking mechanism 46 operable to retain the pliers 10 in a closed or fixed position. The locking mechanism 46 includes a lock link member 48 and an adjustment member 50 (e.g., a control key). A first end 52 of the lock link member 48 is slidably coupled to the upper/upper handle 12 and is axially movable along the upper/upper handle 12. The first end includes an engagement surface 58 with the control key or adjustment member 50. As the adjustment member 50 tightens, the lock link member 48 coupled to the upper handle 12 moves to increase the clamping force at the upper and lower jaws 14, 18. A second end 54 of the lock link member 48 can be pivotally coupled to the lower handle 16 at a pivot pin 56. In other embodiments, the lock link member 48 may be pivotally coupled to the lower handle 16 via one or more pivoting link members, or may directly pivot along the lower jaw 18.

In the illustrated embodiment, a third pivot 60 connects the locked lower handle 16 to the locked lower jaw 18. The force generated through the locking mechanism is transmitted to the third pivot 60 which transmits the force to the lower jaw 18 creating a locking clamping force on a workpiece. A release lever 62 is pivotally coupled to the lower handle 16 at a pin 64. The release lever 62 engages a lobe 66 on the lock link member 48 to release the pliers 10 from the locked or closed position. The locking link member 48 can extend from the upper handle 12 to the lower handle 16 and engage the locking mechanism 46 that locks the lower handle 16 in position relative to the upper handle 12 such that the lower jaw 18 is locked relative to the upper jaw 14.

The adjustment member 50 includes an engagement surface 58 at one end, a threaded shank 68, and a flange 70 extending from the shank 68 opposite the engagement surface 58. The adjustment member 50 is integrally formed as a single component from a metal such as by casting, forging, and the like. The threaded shank 68 is received by a threaded bore 69 in an end of the upper handle 12 opposite the upper jaw 14. The adjustment member 50 is rotatable relative to the upper handle 12 to translate the adjustment member 50 in an axial direction due to the threaded engagement of the shank 68 and the bore 69.

In the illustrated embodiment, the flange 70 includes an elongate opening 72. The elongate opening 72 may enable the use of a tool (e.g., a screwdriver) to penetrate the hole and increase the force applied to locking mechanism 46. The increased clamping force applied by the locking mechanism may increase the available torque applied on a workpiece. Thus, the combination of an elongate opening 72 and a second portion 28 of the lower jaw 18 may combine to increase the torque applied to the workpiece. In some embodiments, the torque may be increased by 10% or more. With an elongate opening 72 in a flange 70 and the rotatable second portion 28 of the lower jaw 18, the torque applied to a workpiece before slipping may increase by more than 20%, 25%, 30%, 40%, 50%, 55%, 60%, 65%, 70%, or more, as compared to standard locking pliers. Flange 70 with an elongate opening 72 and rotatable second portion 28 can increase the torque applied to the workpiece before slipping by 80%, 90%, 100%, 125%, 150%, 175%, or more as compared to standard locking pliers.

Moving the engagement between the engagement surface 58 and the first end 52 of the lock link member 48 causes the lock link member 48 to move with respect to the second pivot pin 56 and adjusts the clamping force the jaws 14, 18 exert on a workpiece when closed. Changing the position of the adjustment member 50 relative to the upper handle 12 changes the distance between the upper jaw 14 and the lower jaw 18 when the lower handle 16 is in a closed position. In some embodiments, the locking pliers 10 further include a spring 74 coupled between the lower jaw 18 and the upper handle 12. The spring 74 biases the lower jaw 18 toward an open position, thus enabling the release of the clamping force on the workpiece. When release lever 62 is pushed and spring 74 engaged, the clamping force on the workpiece is released, and the pliers 10 may be removed or reset relative to the workpiece.

With reference to FIGS. 4 and 5, for any particular distance D between the distal ends 32, 34 of the jaws 14, 18, the first, second, and third jaw faces 94, 102, 134 define the working area or a first clamping diameter Φ1 when the second portion 28 of the movable jaw 18 is in its initial position (FIG. 4). When the lower jaw 18 and the upper jaw 14 engage a workpiece with a clamping force and apply torque, the third set of teeth 24 pivots about the second pivot 30 joint such that a radius from the second pivot 30 joint to the workpiece increases as the torque applied to the handles increases.

The first clamping diameter Φ1 is the diameter of a circle that is tangent to each of the first, second, and third jaw faces 94, 102, 134 (e.g., workpiece engagement surfaces). When the second portion 28 of the movable jaw 18 pivots from the initial position illustrated in FIG. 4 to a pivoted position illustrated in FIG. 5, the first, second, and third jaw faces 94, 102, 134 define a second clamping diameter Φ2, that is smaller than the first clamping diameter Φ1, without varying the distance D between the distal ends 32, 34 of the jaws 14, 18. In the illustrated embodiment, the difference between the first clamping diameter Φ1 and the second clamping diameter Φ2 is greater than 1.58 millimeters. In some embodiments, the difference between the first clamping diameter Φ1 and the second clamping diameter Φ2 can be greater than 1.75 millimeters.

In operation, the locking pliers 10 begin with the upper jaw 14 and the lower jaw 18 in a closed position, and with the lower handle 16 in a closed position, as shown in FIG. 1. As discussed above, a user may adjust the distance D between the distal ends 32, 34 of the jaws 14, 18 while the handles 12, 16 are closed by rotating the adjustment member 50 (causing the movable lower jaw 18 to pivot about a fifth pin 142). The lower handle 16 is then opened with respect to the upper handle 12, further increasing the distance D. With the jaws 14, 18 in an open position (e.g., FIGS. 3 and 4), the user positions the jaws 14, 18 around a workpiece and then pivots the lower handle 16 towards the upper handle 12 to move the lower jaw 18 toward the closed position.

When the jaws 14, 18 are closed and locked on the workpiece, the user may apply a force to the handles 12, 16 to try and rotate the workpiece. This force causes the second portion 28 of the movable jaw 18 to pivot from the initial position (FIG. 4) in the direction of arrow A to a second rotated position (FIG. 5), thereby reducing the clamping diameter of the jaws 14, 18 (e.g., to the clamping diameter Φ2). This reduction in the clamping diameter advantageously increases the clamping force applied to the workpiece and enhances the grip of the jaws 14, 18. Thus, the locking pliers 10 resist slipping on the workpiece at higher applied torques.

For example, a jaw grip test pursuant to ASME Standard B107.24, Section 5.2.4 ("the jaw grip test") was carried out on locking pliers embodying aspects of the invention. During the jaw grip test, the locking pliers were clamped on to a round steel mandrel, with an initial clamping preload between 30 pounds and 35 pounds. With the locking pliers fixed in place, the mandrel rotated at a rate of one degree per second. Maximum torque was measured just before the mandrel slipped and began to rotate relative to the jaws. In some embodiments, the pliers achieved a maximum torque under the jaw grip test of greater than 212 foot pounds, specifically 213-480 foot-pounds and more specifically 233 to 380 foot pounds. In some embodiments, the pliers achieved a maximum torque under the jaw grip test of at least 300 foot-pounds. In some embodiments, the pliers achieved a maximum torque under the jaw grip test of at least 380 foot-pounds. In some embodiments, the pliers achieved a maximum torque under the jaw grip test of at least 400 foot-pounds. In some embodiments, the pliers achieved a maximum torque under the jaw grip test of at least 480 foot-pounds.

Figure 6:
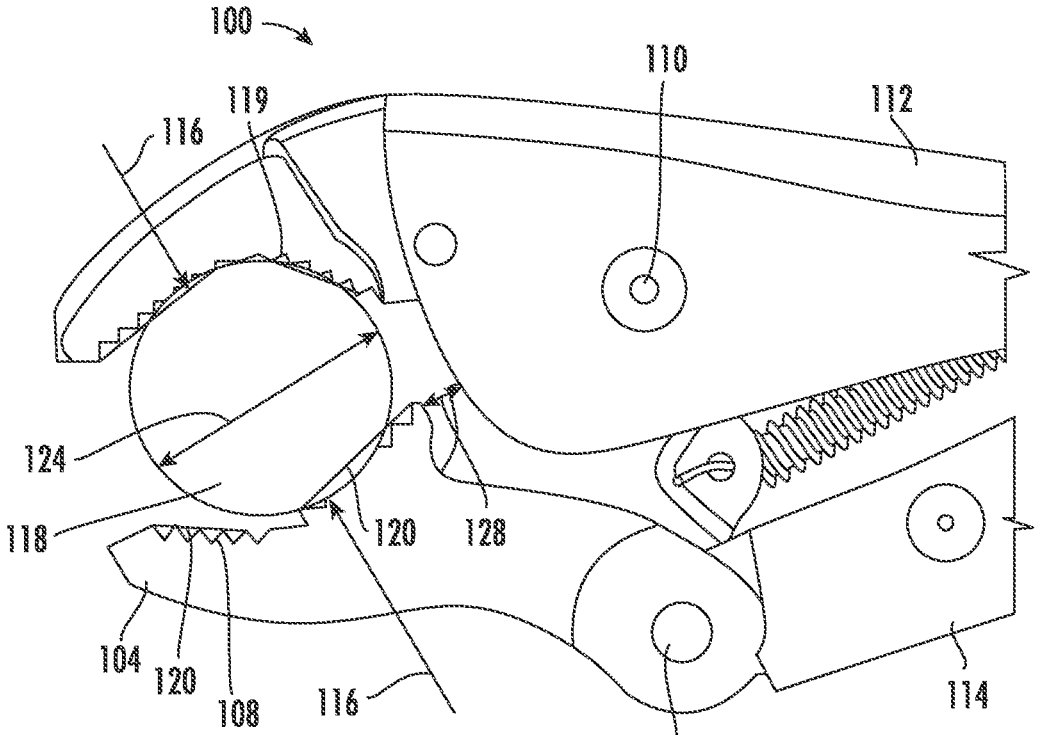
FIG. 6 is a side view of locking pliers with a jaw of the pliers in a first position, according to another embodiment.
Figure 7:
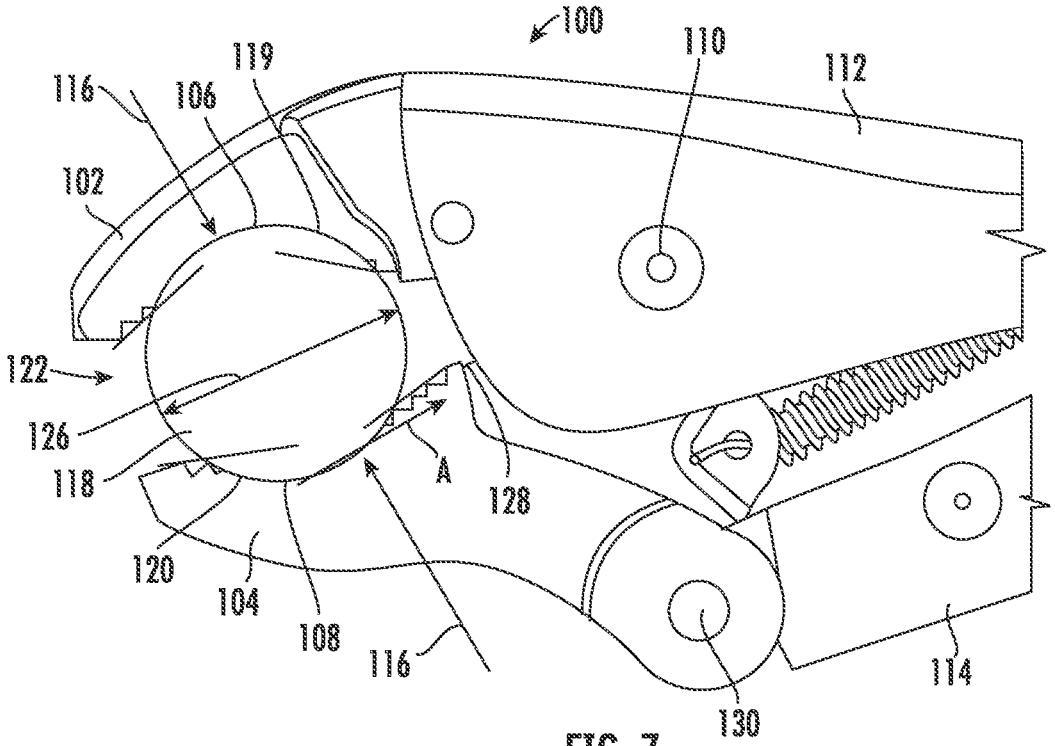
FIG. 7 is a side view of the locking pliers of FIG. 6, with the jaw in a second position, according to an exemplary embodiment.

FIGS. 6-7 illustrate an embodiment of locking pliers 100 with an upper jaw 102 and a lower jaw 104. The second jaw 104 includes all the teeth 120 on the lower jaw 104 and the entire lower workpiece engagement surface 108. The lower jaw 104 is thus rotatable with respect to the upper jaw 102 about the first pivot 110 and second pivot 130. In this embodiment, the entire lower jaw 104 is pivotable about both the first pivot 110 and the second pivot 130.

When a force is applied to close the handles 112, 114, the pliers 100 close around the workpiece 118. Due to the mechanical advantage of the pliers 100, there is a greater resultant clamping force on workpiece 118, e.g., a compressive force between the jaws 102, 104. Additionally, when the user applies a force to handles 112, 114 of the closed or locked pliers 100, moving jaw 104 further multiplies the resultant compressive clamping force on the workpiece 118. When the pliers 100 upper and lower jaws 102, 104 are closed or engaged on a workpiece 118, the working area 122 defines a maximum first diameter 124 of the workpiece 118 that can fit between the active workpiece engagement surfaces 106, 108. The first diameter 124 is reduced to a second diameter 126 (shown in FIG. 7) as torque is applied to the handle by the user.

The upper jaw 102 comprises an upper workpiece surface 106, including two planes of teeth off-set by an oblique angle. The lower jaw 104 includes a lower workpiece engagement surface 108 with a similar configuration (e.g., two planes of teeth off-set by an oblique angle). In this configuration, the lower workpiece engagement surfaces 108, on the lower jaw 104 rotate as a single unit about pivot 130. As illustrated, the lower workpiece engagement surface 108, on the lower jaw 104, rotates relative to the upper jaw 102 about a first pivot 110. When the upper handle 112 and lower handle 114 move toward one another (e.g., a clamping force is applied), the upper jaw 102 moves relative to the lower jaw 104, generating a clamping force 116 on workpiece 118. The upper workpiece surface 106 comprises a first set of teeth 119. As described above, the lower workpiece engagement surface 108 includes the entire length of a single rotatable second set of teeth 120. The lower workpiece engagement surface 108 is measured from the frontmost to the rearmost teeth along the lower jaw 104. As illustrated in FIGS. 6-7 and described above, the length of the rotatable lower workpiece engagement surface 108 may comprise the entire lower jaw 102. Although illustrated on the lower jaw 104, the rotatable workpiece engagement surface may be similarly disposed on the upper jaw 102.

When the clamping force 116 is distributed on the workpiece 118, the working area 122 encircled by the upper jaw 102 and the lower jaw 104 decreases and deforms to create a first diameter 124 of the workpiece with the clamping force applied. As illustrated in FIG. 7, as the workpiece is rotated the working area 122 decreases as the lower jaw 104 rotates in the direction of A and exerts a greater clamping force 116 on the workpiece 118. This increased clamping force 116 may create a second diameter 126 in the workpiece 118. As the workpiece 118 experiences torque, friction causes the distance 128 shrinks until the second jaw contacts the upper handle 112 and maximizes the clamping force. For example, compare the distance 128 in FIG. 6 to the rotated distance in FIG. 7.

Figure 8:
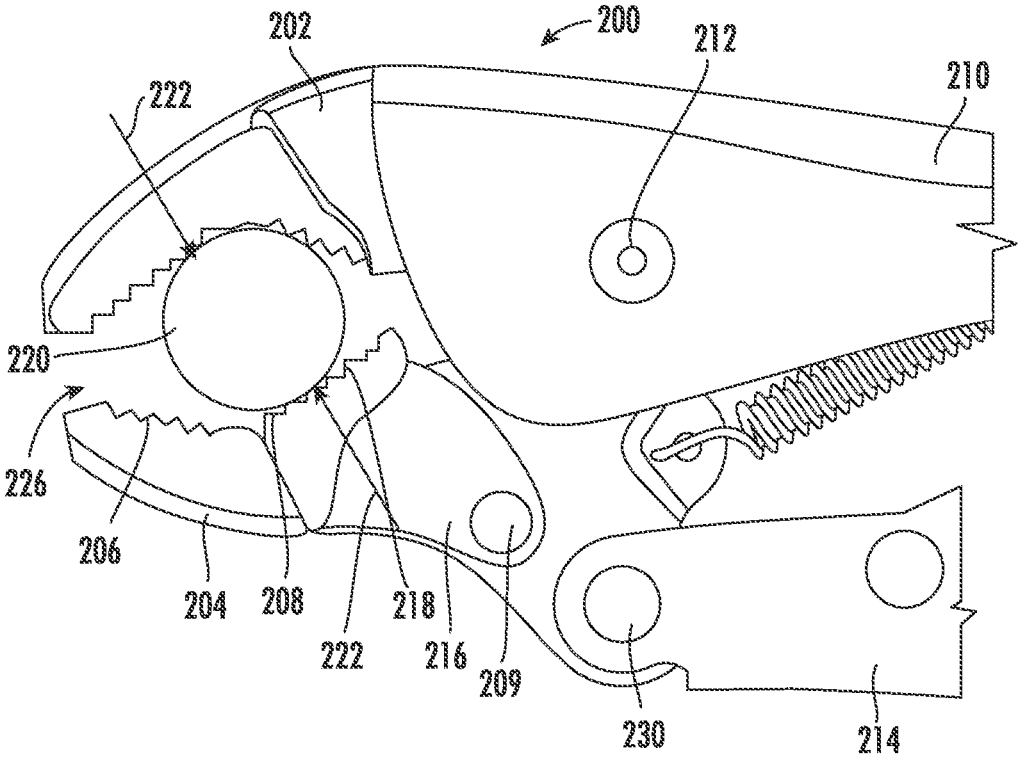
FIG. 8 is a side view of locking pliers, with the jaw in the first position, according to another embodiment.
Figure 9:
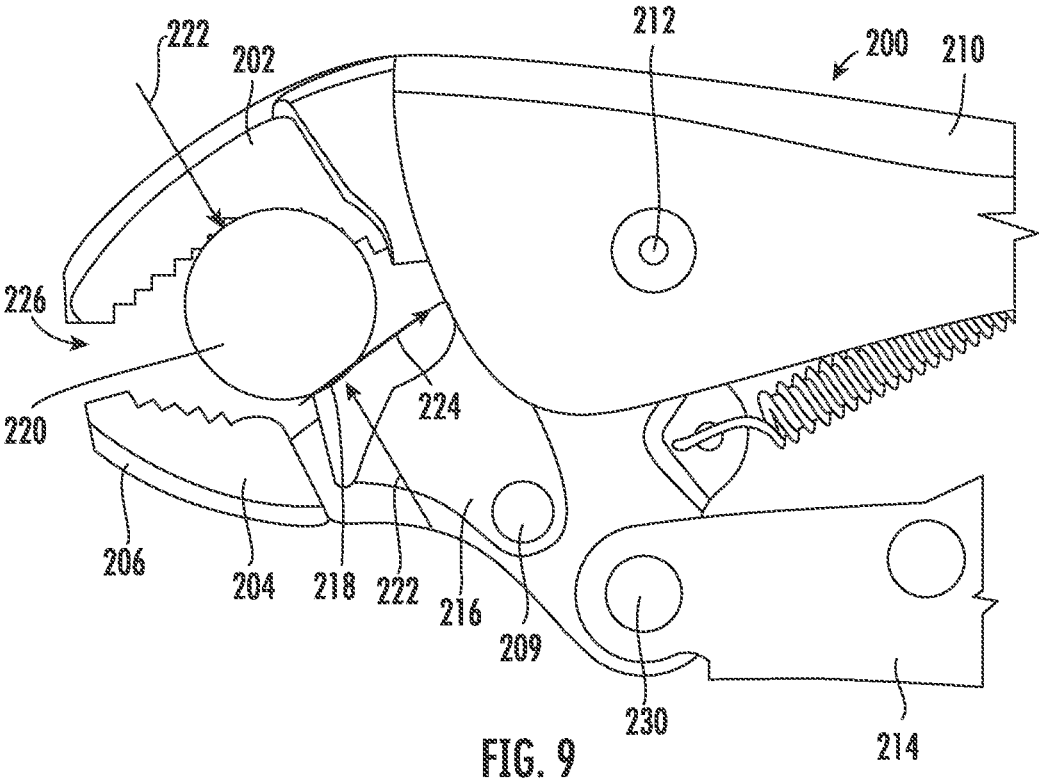
FIG. 9 is a side view of the locking pliers of FIG. 8 with the teeth on the second jaw in a second position, according to an exemplary embodiment.

FIGS. 8-9 illustrate another embodiment of pliers 200 with a rotatable surface. The embodiment of FIGS. 8-9 is substantially the same as the embodiment of FIGS. 1-5 except for the differences described. In contrast to the design of pliers 10, the second jaw portion 216 of pliers 200 has a thickened second jaw face 218 to enhance the area applying a clamping force on workpiece 220.

Pliers 200 include an upper jaw 202 and a lower jaw 204 coupled through a first pivot 212. The lower jaw 204 includes a jaw face 206 and a second portion 208 integrally formed with the jaw face 206 and pivotable about the lower jaw 204 about a second pivot 209. The lower jaw 204 is pivotably pinned to the upper handle 210 at a first pivot 212 and to the lower handle 214 at a third pivot.

The pliers 200 include a second jaw portion 216 with a thickened second jaw face 218. The second jaw portion 216 is rotatably coupled (e.g., through second pivot 209) to the lower jaw 204.

When the pliers 200 are closed around a workpiece 220, a clamping force 222 is generated based on the lever action of the handles. Because of the thickened second jaw face 218 this force is distributed to a larger area of the workpiece 220 to prevent slipping and distribute the gripping force more evenly. As torque is applied to the workpiece 220 (e.g., a rotation force at the upper and lower handles 210 and 214), the second jaw portion 216 pivots in direction 224. The movement in the second jaw portion 216 in direction 224 rotates towards the upper jaw 202 and upper handle 210. This rotation reduces the working area 226 between the second jaw portion 216 and the upper jaw 202. The reduced working area 226 creates an increased clamping force on the workpiece 220 to increase the amount of torque applied before slippage of the workpiece 220.

Figure 10:
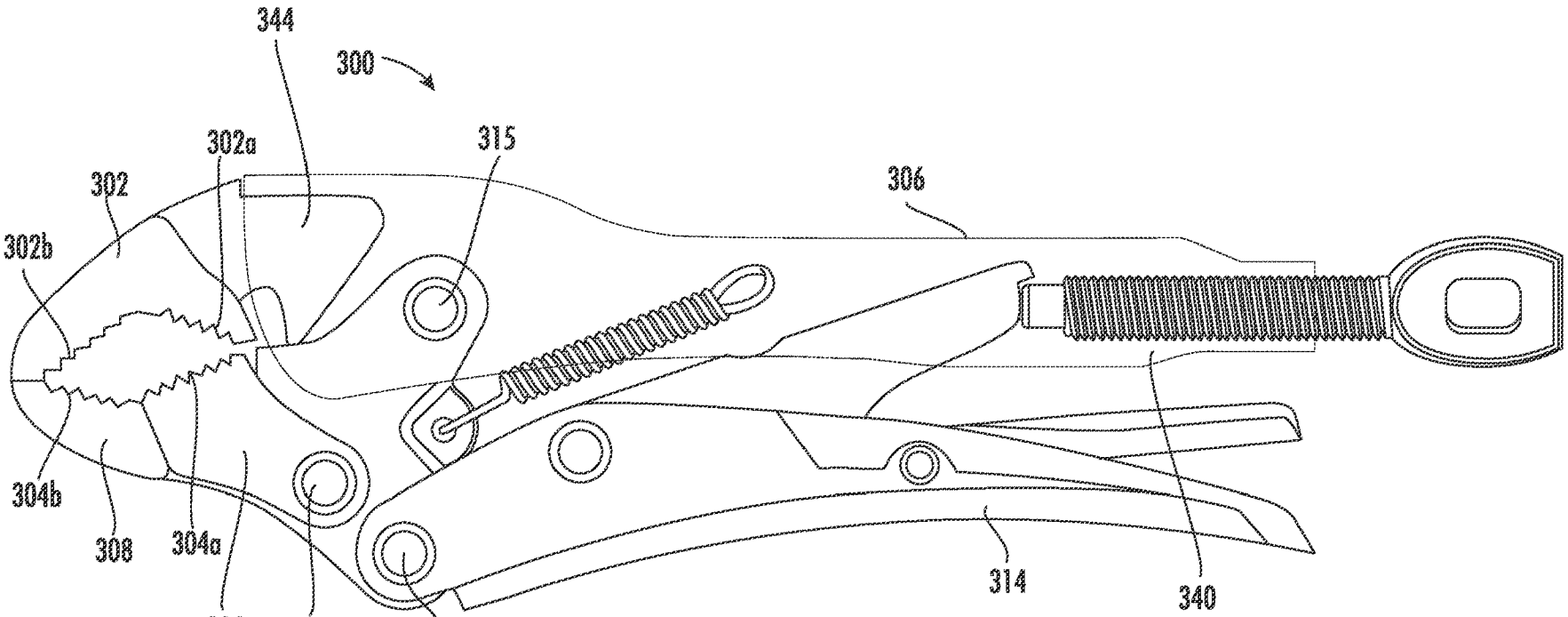
FIG. 10 is a side view of locking pliers with movable rotatable teeth about the first and second jaw, according to another embodiment.

FIG. 10 illustrates another embodiment of pliers 300. Pliers 300 are substantially the same as or similar to pliers 10, 100, and 200 as described above except for the differences described. In contrast to the design of pliers 10, 100, and 200, the upper and lower handles 306, 314 clamp about a central shaft 440. In addition, upper jaw 302 is coupled to the upper handle through an oblong joint 344 that allows the upper jaw 302 to release the clamping force on a workpiece when the jaws are unlocked, but to exert the same or substantially the same clamping force on the workpiece when the jaws are locked.

An upper jaw 302 has a first set of teeth (e.g., teeth 302*a* and 302*b*). The lower jaw 304 has two sections, a rotatable section 306 and clamping section 308. The rotatable section 306 clamps and rotates about pivot 330 and the clamping section 308 induces a clamping force. Both sections rotate about pivot 315. Teeth 304*a* are on the rotatable section 306. Teeth 304*b* are on the clamping section 308. Teeth 302*a* and 302*b* (e.g., the first set of teeth) on the upper jaw 302 may combine into an upper workpiece engagement surface. Teeth 304*b* rotatable about pivot 315 define the second workpiece engagement surface. The lower jaw includes teeth 304*a* pivotable about two points (pivot 315 and pivot 330) defining a third workpiece engagement surface. The rotation of teeth 304*a* reduces the working-diameter and increases the clamping force as torque is applied to the workpiece.

Figure 11:
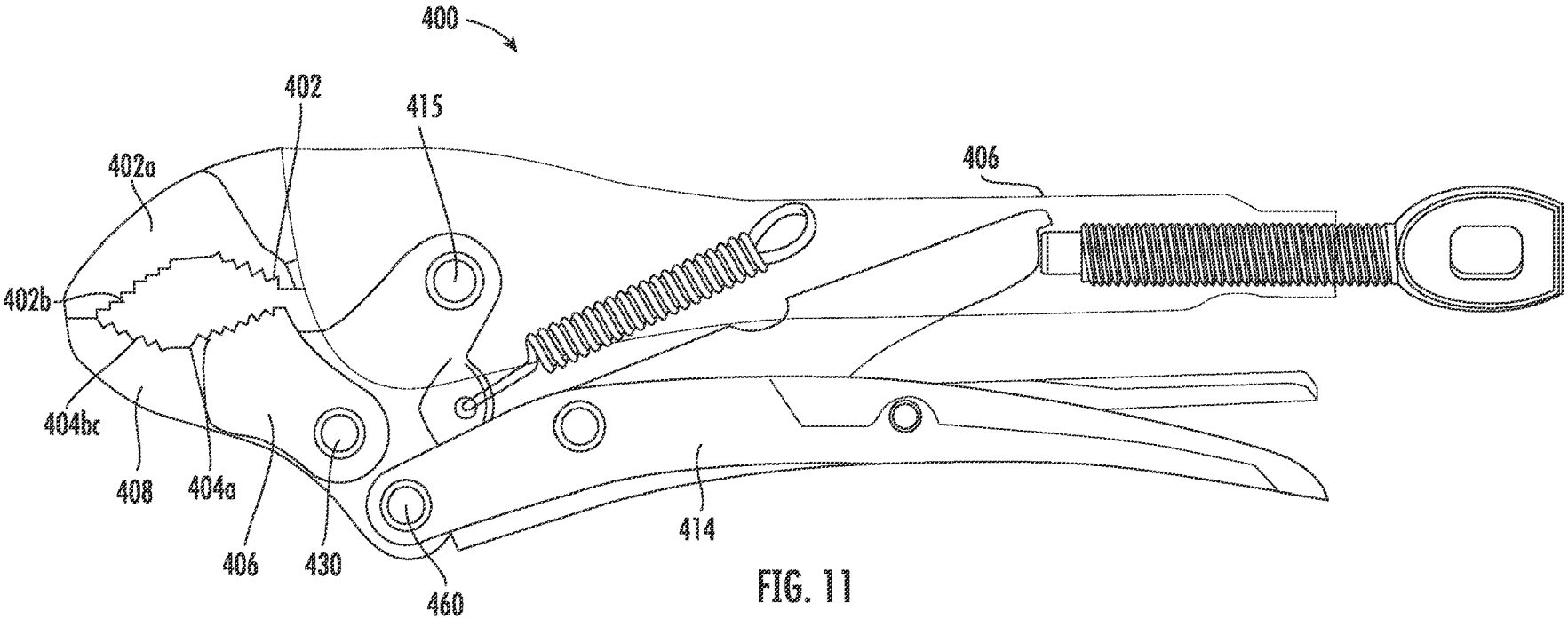
FIG. 11 is a side view of locking pliers with movable rotatable teeth about the first and second jaw, according to another embodiment.

FIG. 11 illustrates a pair of pliers 400 according to another embodiment. Pliers 400, illustrated in FIG. 11, are the same as or similar to pliers 10, 100, 200, and 300 as described above with the differences described below. In contrast to the design of pliers 10, the second jaw face 406 is curved to enhance the arc of rotation. The curved shaped construction enables the shoulder of the second jaw face 406 to rotate from a different first position through an arc of rotation that decreases the workpiece area and into a different second position abutting the upper handle 406.

Pliers 400 include an upper jaw 402 and a lower jaw 404 each having two separate sets of teeth. The upper set of teeth or upper workpiece engagement surface of the upper jaw 402 includes the teeth 402*a* and 402*b*. The lower jaw includes two different sets of teeth 404*a* and 404*b*. Teeth 404*a* rotate about a first pivot 15 and a second pivot 30. Teeth 404*b* rotate about the first pivot 15 only. As illustrated, the teeth 402*a*, 402*b*, 404*a*, 404*b* are coupled at an obtuse angle but may be acute, parallel, or curved. The Combining the overall shape of teeth 402*a*, 402*b*, 404*a*, 404*b* with rotatable teeth 404*a* increases the applied clamping force.

Figure 12:
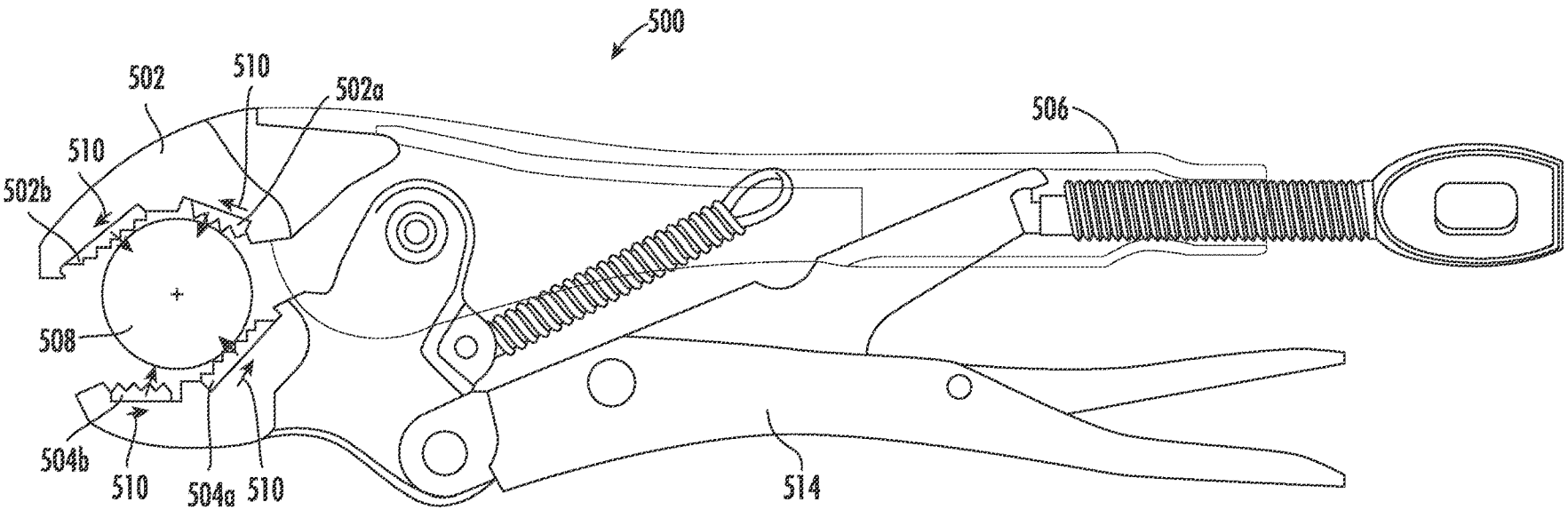
FIG. 12 is a side view of locking pliers with movable translating teeth about the first and second jaw, according to another embodiment.

FIG. 12 illustrates a locking pliers 500 according to another embodiment. The locking pliers 500 are substantially the same or similar to pliers 10 as described above, except for the differences described. In contrast to the design of pliers 10, the teeth of pliers 500 do not rotate. Instead the teeth of pliers 500 translate along a slope to reduce the working area on a workpiece.

The pliers 500 include an upper jaw 502 and a lower jaw 504 each having two separate sets of teeth. The upper jaw 502 includes the translatable teeth 502*a* and 502*b*. The lower jaw includes the translatable teeth 504*a* and 504*b*. As illustrated, the teeth 502*a*, 502*b*, 504*a*, 504*b* are coupled at an obtuse angle. In some embodiments, the teeth may be spring-loaded or biased such that when the user provides a rotational force 506 at the handles and the teeth provide torque to a workpiece 508, the teeth translate or slide. For example, the teeth may translate up the ramps as indicated by the arrows 510. This translation enables the teeth to reduce the diameter on the workpiece 508 and increase the clamping force. The arrows 510 illustrate the direction the teeth can translate when a torque reduces the working area (illustrated by arrows 512) and the teeth translate. This translation increases the clamping force on the workpiece 508 and reduces the slipping the locking pliers 500 experience when applying a rotational load 506.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes, and omissions may also be made in the design, operating conditions and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. In addition, in various embodiments, the present disclosure extends to a variety of ranges (e.g., plus or minus 30%, 20%, or 10%) around any of the absolute or relative dimensions disclosed herein or determinable from the Figures.

What is claimed is:

1. Locking pliers, comprising:

an upper handle;

a lower handle;

an upper jaw coupled to the upper handle, the upper jaw comprising a first set of teeth;

a lower jaw coupled to the lower handle, the lower jaw comprising a second set of teeth and a third set of teeth, wherein the lower jaw opposes the upper jaw such that the first set of teeth faces the second set of teeth and the third set of teeth;

a working area defined between the upper jaw and the lower jaw;

a first pivot joint coupling the lower handle to the upper handle such that the upper handle is movable relative to the lower handle to move the lower jaw relative to the upper jaw; and a second pivot joint coupling the second set of teeth to the lower jaw, wherein the third set of teeth on the lower jaw are pivotable about the first pivot joint and the second set of teeth on the lower jaw are pivotable about the first pivot joint and about the second pivot joint;

wherein the working area decreases as the second set of teeth rotate about the second pivot joint.

2. The locking pliers of claim 1, wherein when a clamping force is applied to the upper handle and the lower handle and the upper handle and the lower handle are rotated in a clockwise direction, a torque causes the second set of teeth to pivot about the second pivot joint.

3. The locking pliers of claim 1, wherein when the lower jaw and the upper jaw engage a workpiece and when force is applied to the upper handle and the lower handle to apply a torque to the workpiece, the second set of teeth pivots about the second pivot joint such that a radius from the second pivot joint to the workpiece increases as the torque applied to the handles increases.

4. The locking pliers of claim 1, wherein, when a force is applied to the upper handle and the lower handle in a first rotational direction, the second set of teeth pivot about the second pivot joint in the first rotational direction to apply a torque on a workpiece in the first rotational direction.

5. The locking pliers of claim 1, wherein the second set of teeth provide a lever arm that increases an amount of torque applied on a workpiece without slipping as force is applied to the upper handle and the lower handle.

6. The locking pliers of claim 1, further comprising a locking mechanism configured to lock a position of the upper jaw relative to the lower jaw.

7. The locking pliers of claim 6, further comprising a locking link extending between the upper handle and the lower handle, wherein the locking mechanism engages the locking link, locking the lower handle in position relative to the upper handle such that the lower jaw is locked relative to the upper jaw.

8. The locking pliers of claim 1, wherein the second pivot joint allows the second set of teeth to rotate about the second pivot joint independent of the first pivot joint.

9. The locking pliers of claim 1, comprising:

a height axis, wherein the second pivot joint is spaced from the first pivot joint in a direction of the height axis such that the second pivot joint is located between the first pivot joint and the lower handle in the direction of the height axis; and a longitudinal axis, wherein the second set of teeth are located behind the third set of teeth such that the second set of teeth are located between the third set of teeth and the first pivot joint in a direction of the longitudinal axis.

10. The locking pliers of claim 1, wherein the second set of teeth comprise a plurality of teeth aligned on a plane.

11. Pliers, comprising:

a first assembly comprising a first handle, a first jaw, a first workpiece engagement surface, and a second workpiece engagement surface;

a second assembly comprising a second handle, a second jaw, a third workpiece engagement surface, and a fourth workpiece engagement surface; and a pivot joint pivotably coupling to the first assembly to the second assembly such that the second handle is movable relative to the first handle to move the second jaw relative to the first jaw;

wherein the third workpiece engagement surface is movably coupled to the second jaw such that the third workpiece engagement surface moves relative to the fourth workpiece engagement surface such that a working area defined between the first jaw and the second jaw decreases the working area as torque is applied to a workpiece.

12. The pliers of claim 11, wherein the first workpiece engagement surface and the second workpiece engagement surface are rigidly coupled to the first jaw, wherein the third workpiece engagement surface moves relative to the second jaw, and the fourth workpiece engagement surface is rigidly coupled to the second jaw.

13. The pliers of claim 11, further comprising a second pivot joint pivotably coupling the third workpiece engagement surface to the second jaw such that movement of the third workpiece engagement surface relative to the fourth workpiece engagement surface is a pivoting movement.

14. The pliers of claim 11, wherein the working area is shaped to fit a curved workpiece within the working area.

15. The pliers of claim 11, wherein movement of the third workpiece engagement surface relative to the fourth workpiece engagement surface increases a radius from the third workpiece engagement surface to the workpiece and increases a maximum amount of the torque that can be applied to the workpiece when a force is applied to the first handle and the second handle to apply the torque to the workpiece.

16. A tool for grasping a workpiece, comprising: a first handle; a first jaw; a first workpiece engagement surface coupled to the first jaw; a second handle; a second jaw; a second workpiece engagement surface coupled to the second jaw; a first joint coupling the first jaw to the second jaw, the first and second handles being movable relative to each other, wherein movement of the first and second handles relative to each other causes the second jaw to move relative to the first jaw; and a second joint coupling the second workpiece engagement surface to the second jaw, wherein the second joint allows the second workpiece engagement surface to move relative to the second jaw; wherein the first jaw and second jaw define a first clamping diameter between the first jaw and the second jaw, wherein the first clamping diameter decreases as the second workpiece engagement surface moves relative to the second jaw as a torque is applied to the workpiece.

17. The tool of claim 16, wherein when the second workpiece engagement surface pivots, the first jaw and the second jaw define a second clamping diameter between the first jaw and the second jaw, and wherein the second clamping diameter is less than the first clamping diameter.

18. The tool of claim 17, wherein a difference between the first clamping diameter and the second clamping diameter is greater than 1.58 millimeters.

19. The tool of claim 16, further comprising:

a lock link member coupled to the first handle and extending to a third pivot locking the second handle relative to the first handle and the first jaw relative to the second jaw;

an adjustment member at least partially received within and rotatable relative to the first handle; and a flange with an elongate opening at an outer end of the adjustment member.

20. The tool of claim 19, wherein when the adjustment member is rotated in a tightening direction, a clamping force of the first jaw and the second jaw is increased.

* * * * *